US005145268A

United States Patent [19]

Cavallini

[11] Patent Number: 5,145,268

[45] Date of Patent: Sep. 8, 1992

[54] CASSETTE CONTAINING AN INKED RIBBON

[75] Inventor: Alberto Cavallini, Assago, Italy

[73] Assignee: Incas Holding S.p.A., Milan, Italy

[21] Appl. No.: 612,490

[22] Filed: Nov. 14, 1990

[30] Foreign Application Priority Data

Nov. 16, 1989 [IT] Italy ..... 22106/89[U]

[51] Int. Cl.[5] ..... B41J 32/02; B41J 33/10

[52] U.S. Cl. ..... 400/196.1; 400/235.1

[58] Field of Search ..... 400/234, 196.1, 236, 400/248, 208, 235, 235.1

[56] References Cited

U.S. PATENT DOCUMENTS

| | | | |
|---|---|---|---|
| 3,520,495 | 7/1970 | Sotani | 400/236 X |
| 4,210,403 | 7/1980 | Mazouet et al. | 400/235.1 X |
| 4,325,645 | 4/1982 | Miyajima et al. | 400/196.1 |
| 4,406,554 | 9/1983 | Dreinhoff et al. | 400/236 X |
| 4,451,166 | 5/1984 | Frechette et al. | 400/235 X |
| 4,502,801 | 3/1985 | Hefti et al. | 400/234 X |
| 4,780,011 | 10/1988 | Hasegawa et al. | 400/242 |
| 5,044,794 | 9/1991 | Simoyama et al. | 400/208 |
| 5,051,010 | 9/1991 | Stephens et al. | 400/196.1 X |

FOREIGN PATENT DOCUMENTS

| | | |
|---|---|---|
| 333375 | 9/1989 | Austria . |
| 0313245 | 4/1989 | European Pat. Off. . |
| 2141073 | 12/1984 | United Kingdom . |
| 2159124 | 11/1985 | United Kingdom . |

*Primary Examiner*—Edgar S. Burr
*Assistant Examiner*—Moshe I. Cohen
*Attorney, Agent, or Firm*—Oliff & Berridge

[57] ABSTRACT

In the proposed cassette containing an endless inked ribbon, at least one pulling roller is partly supported in a rotatable manner, in at least one slot provided in a wall of the cassette, and is at least partly supported in a rotatable manner in a carriage which is mobile relative to a wall of the cassette and is engaged with elastic means able to urge said roller against abutment means on said slot.

4 Claims, 3 Drawing Sheets

CASSETTE CONTAINING AN INKED RIBBON

FIELD OF THE INVENTION

This invention relates to a cassette containing a zig-zag accumulated endless inked ribbon suitable for use in printers.

PRIOR ART

Cassettes of the aforesaid type are generally provided with inked ribbon feed mechanisms formed from toothed or untoothed pulling rollers, one driving and the other driven, between which the ribbon is interposed to engage the rollers or be wedged between the engaging teeth, and thus be dragged by friction.

The pulling rollers can have a fixed or variable distance between their axes. In the second case, the rollers are spaced apart on assembly, to facilitate the insertion of the ribbon between them. In some feed mechanisms comprising pulling rollers with variable spacing, one of the rollers is pivoted on a support arm which is itself pivoted within the cassette and subjected to the action of a spring, which urges one of the two wheels towards the other. This method is not without drawbacks. These mainly derive from the greater friction between the ribbon and rollers, with consequent increase in the minimum torque required to turn the drive roller, and the variation in these parameters with the spring setting. Further drawbacks of this method are a certain constructional complexity and the laboriousness of the assembly operations.

SUMMARY OF THE INVENTION

The main aspect of the invention is a cassette comprising a ribbon feed mechanism with pulling rollers of variable distance between axes, which eliminates the variability of the functional parameters of known methods.

A further aspect of the invention is a cassette in which the feed mechanism can be mounted in a simple and reliable manner.

The cassette is characterised, according to the invention, in that at least one pulling roller is partly supported, in a rotatable manner, in at least one slot provided in a wall of a cassette, and is at least partly supported in a rotatable manner in a carriage which is mobile relative to a wall of the cassette and is engaged with elastic means able to urge said roller against abutment means on said slot.

According to a preferred embodiment, said elastic means are a flat spring, said flat spring being advantageously formed integrally with said holding member.

The proposed system provides various improvements, such as take-up of slack due to constructional or operational tolerances, reduction in friction between the ribbon and pulling rollers, a more constant spring loading, and simplification of assembly of the mechanism.

DETAILED DESCRIPTION OF THE INVENTION

Characteristics and advantages of the invention are described hereinafter with reference to the accompanying FIGS. 1 to 4, which show a preferred embodiment of the invention by way of non-limiting example.

Figure 1:
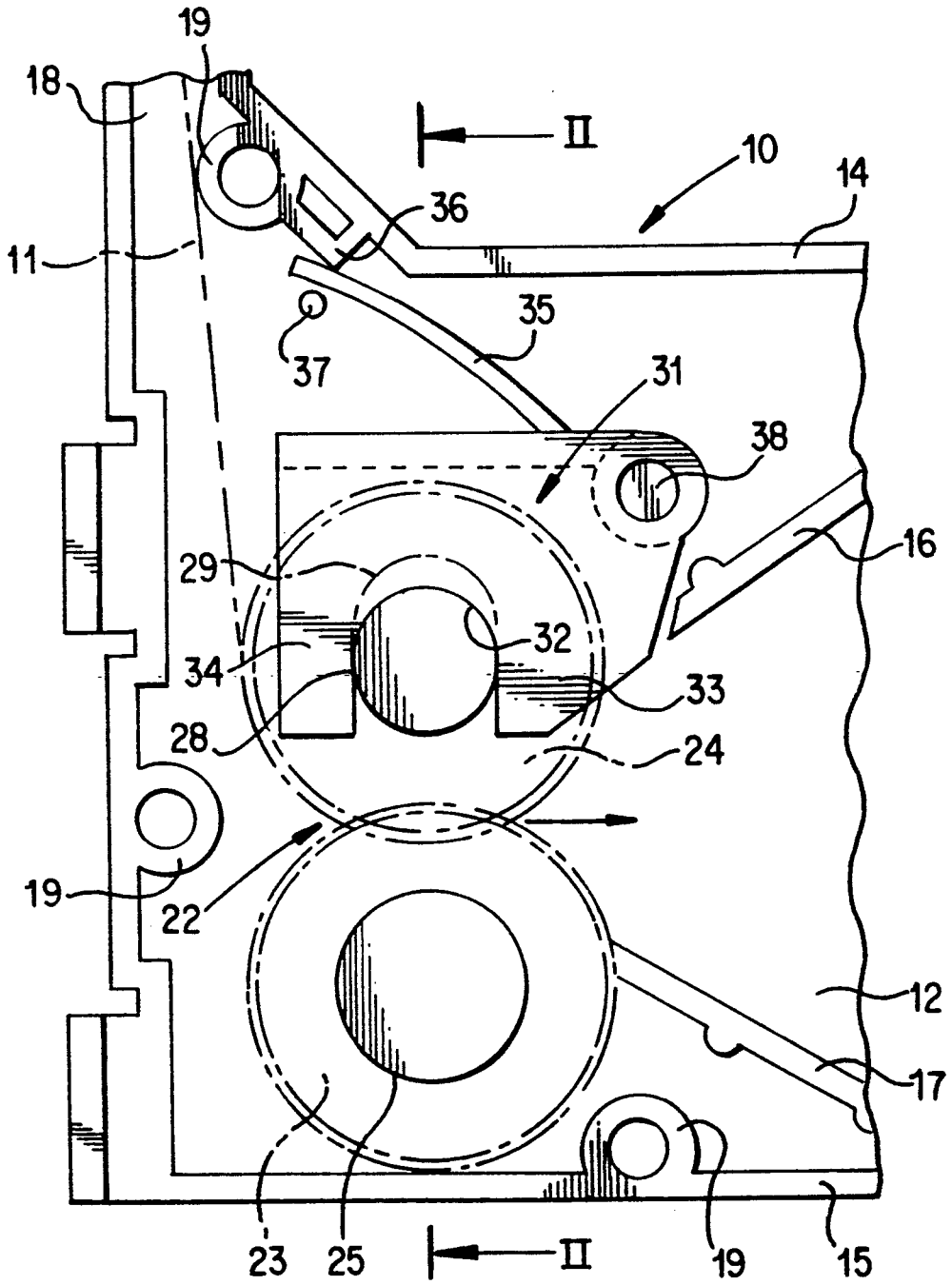
FIG. 1 is a partial plan view of a cassette comprising an inked ribbon feed mechanism according to the invention.
Figure 2:
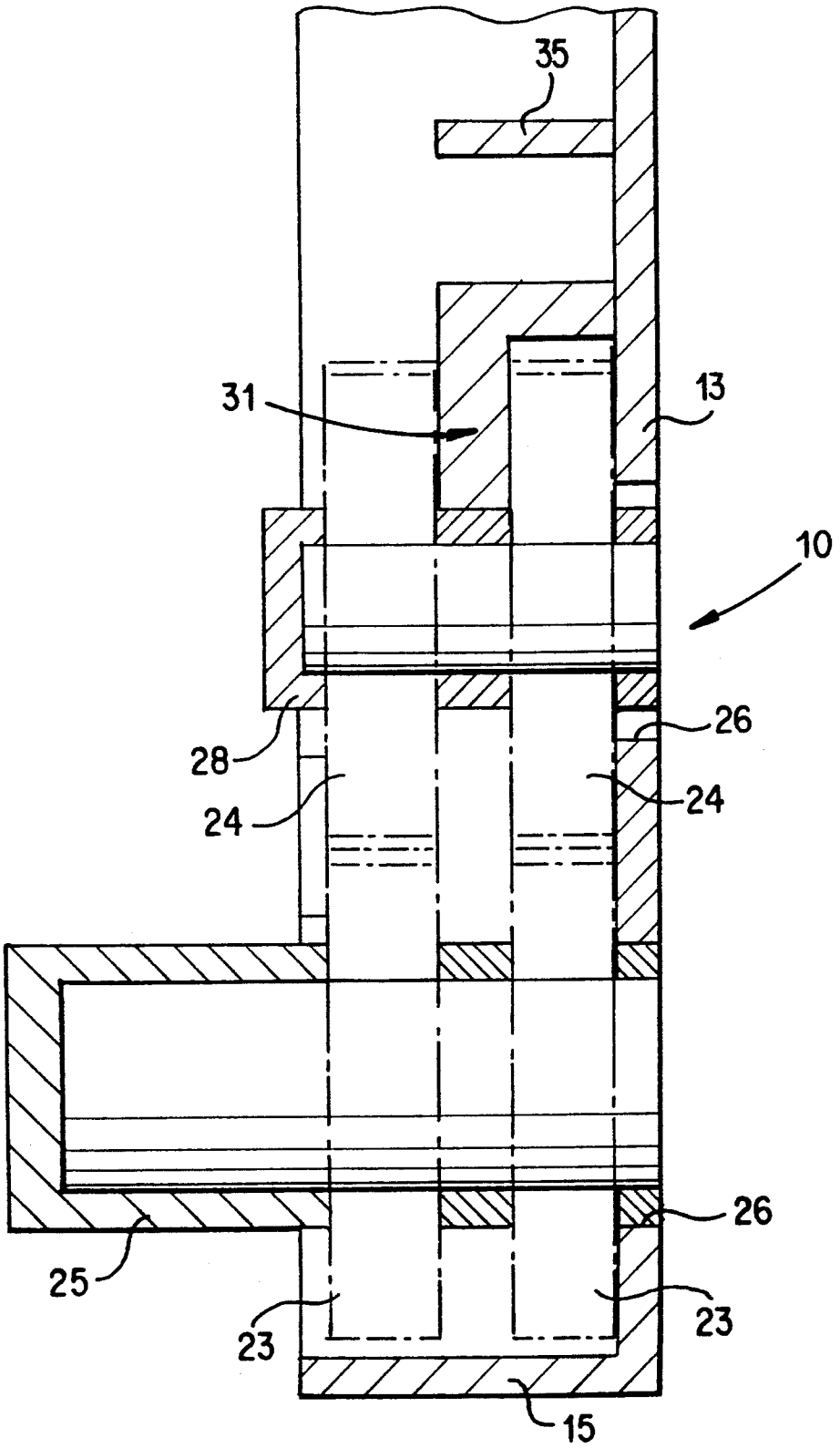
FIG. 2 is a section on the line II—II of FIG. 1.

In FIGS. 1 and 2 the reference numeral 10 indicates overall a cassette for an endless inked ribbon, indicated by 11, which is housed in a zig-zag manner in the partly shown chamber 12 of said cassette 10.

The chamber 12 is defined by the base wall 13, the side walls 14 and 15 and the inclined walls 16 and 17 which define the entry section to the chamber. The exit section for the ribbon 11 from the chamber 12 is not shown in the figures.

Figure 3:
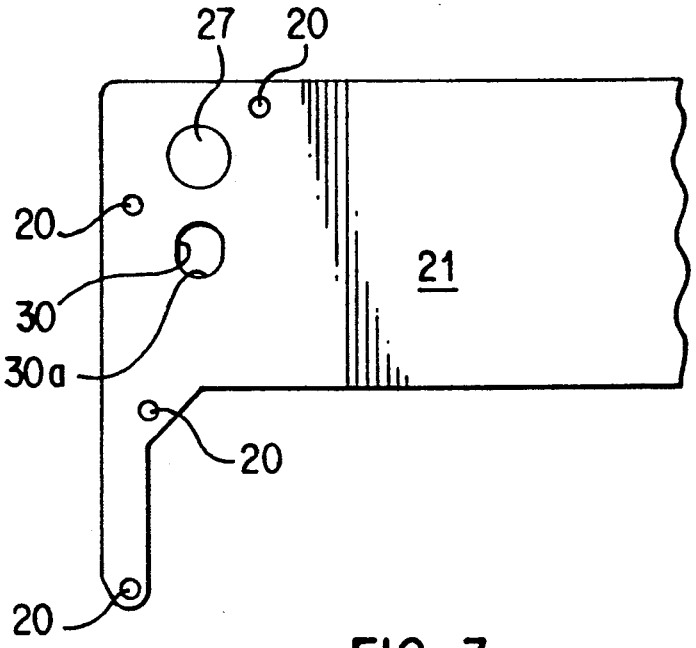
FIG. 3 is a partial view of the lid of the cassette of FIGS. 1 and 2 to a reduced scale.
Figure 4:
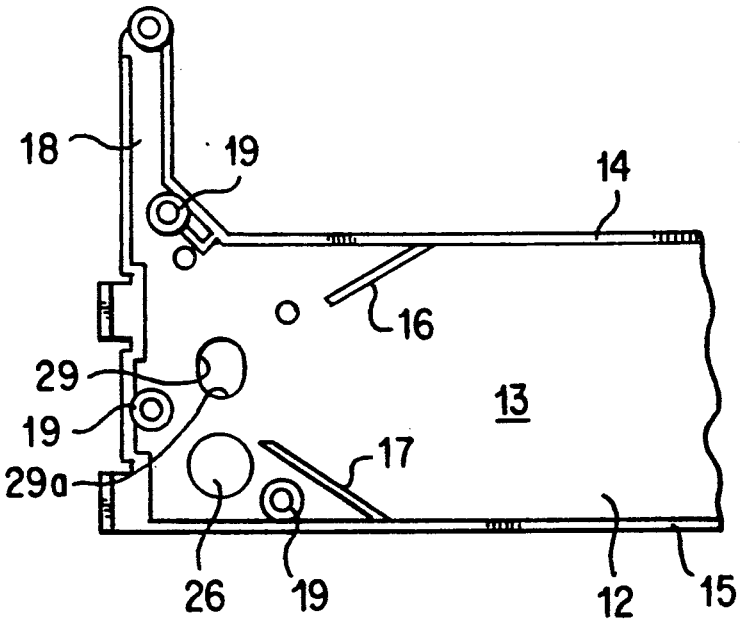
FIG. 4 is a partial view of the base wall of the cassette of FIGS. 1 and 2 to a reduced scale.

The reference numeral 18 indicates an entry channel for the ribbon 11 into the cassette, and 19 indicates a hollow boss arranged to receive one of the pins 20 of the lid 21, shown in FIG. 3, when the cassette is closed. FIGS. 1 and 4 show further hollow bosses 19 into which corresponding pins 20 of the lid 21 are inserted to close the cassette.

The reference numeral 22 indicates overall the feed mechanism for the ribbon 11, comprising the two pulling rollers 23 and 24, of which one drives and the other is driven and which in this particular case are toothed and made of suitable plastic material. The rollers 23 and 24 could instead have their lateral walls smooth and be constructed of a suitable plastic material to provide the friction force necessary for pulling the ribbon 11.

The pivot 25 of the toothed roller 23 is rotatably supported in the holes 26 and 27 provided in the base wall 13 and lid 21, as shown in FIGS. 3 and 4.

The pivot 28 of the toothed roller 24 is partly and rotatably supported in the slots 29 and 30 provided in the base wall 13 and lid 22, as shown in FIGS. 3 and 4. The slots 29 and 30 are provided with abutments formed by their edges 29*a* and 30*a*.

The pivot 28 is also supported by the carriage indicated overall by 31. For this purpose the carriage 31 comprises a semicylindrical sleeve 32 and two curved arms 33 and 34 which partly embrace said pivot. The carriage is constructed of plastic material such as ABS, the two arms 33 and 34 therefore being elastically deformable within certain limits.

The carriage 31 is pivoted to the base wall 13 by the pin 38, and is provided with a flat spring 35 formed integrally with the carriage, of plastic material.

The free end of the spring 35 is retained between the angular projection 36 formed on the wall 14 and a pin 37 so that the spring 35 is put under a determined load when the carriage 31 is mounted on the pin 38 and the pivot 28 in the slot 29.

The extent of loading of the spring 35 depends on the thickness of the flat part of the spring 35 and its angle of inclination to carriage 31, and is influenced by the dimensional tolerances of the components of the cassette 10.

On assembling the cassette 10, the pivot 25 of the toothed roller 23 is mounted in the hole 26, and the carriage 31, in which the roller 24 is premounted, is mounted on the pin 38 so that the pivot 28 enters the slot 29 and the free end of the spring 35 is retained between the angular projection 36 and pin 37.

The endless inked ribbon 11 is loaded into the chamber 12 in zig-zag arrangement; the return branch of the ribbon 11 passes into the entry channel 18 and through the free space between the pulling rollers 23 and 24, to enter the chamber 12.

The loading of the spring 35 causes the carriage 31 to urge the pivot 28 of the roller 24 against the abutment formed by the edge 29*a* of the slot 29, so that the return branch of the ribbon 11 becomes inserted between the rollers 23 and 24 and wedged between their teeth.

The feed mechanism is now able to drag the ribbon 11 and feed it into the chamber 12 when the cassette is in operation on a printer. The assembly of the cassette 10 is completed with the closure of the lid 21, done by inserting the pins 20 into the hollow bosses 19, the pivots 25 and 28 thus entering the hole 27 and the slot 30 respectively.

The described feed mechanism has various advantages.

When the toothed rollers 23 and 24 are mounted, the distance between their pivots 25 and 28 is always the scheduled design distance because the flat spring 35 takes up any slack due to constructional or operational tolerances, an in addition the friction between the ribbon 11 and the teeth of the rollers 23 and 24 remains within acceptable levels as does the minimum turning torque for the drive roller 23, because of the presence of the abutment formed by the edge of the slot 29.

In addition, with a flat spring such as the spring 35 formed integrally with the carriage 31, the spring elastic loading can be preset accurately and the mechanism assembly is much simplified, resulting in reduced assembly coasts and increased operational reliability.

I claim:

1. A cassette containing an endless inked ribbon zigzag accumulated in a chamber and provided with a ribbon feed mechanism, comprising: a pulling drive roller and a pulling driven roller, wherein at least one pulling roller is partly supported, in a rotatable manner, in at least one slot provided in a wall of a cassette, and is at least partly supported in a rotatable manner in a carriage secured by a pin to the wall of the cassette, the carriage being rotatable about the pin to be mobile relative to the wall of the cassette, the carriage being engaged with elastic means for urging said at least one pulling roller against abutment means on said at least one slot, said elastic means being formed integrally with said carriage and engaging a second wall of the cassette.

2. A cassette as claimed in claim 1, wherein said carriage comprises a semicylindrical sleeve and two elastically deformable curved arms, which partly support the pivot of said at least one pulling roller, said pivot being also partly supported by said abutment means of said slot.

3. A cassette as claimed in claim 1, wherein said elastic means are in the form of a flat spring.

4. A cassette as claimed in claim 3, wherein said carriage and flat spring are constructed of a suitable plastic material.

* * * * *